US011324267B2

(12) United States Patent
Craft

(10) Patent No.: US 11,324,267 B2
(45) Date of Patent: May 10, 2022

(54) CUMMERBUND BELT ASSEMBLY

(71) Applicant: David Craft, Plainfield, IL (US)

(72) Inventor: David Craft, Plainfield, IL (US)

( * ) Notice: Subject to any disclaimer, the term of this patent is extended or adjusted under 35 U.S.C. 154(b) by 197 days.

(21) Appl. No.: 16/742,324

(22) Filed: Jan. 14, 2020

(65) Prior Publication Data

US 2021/0212399 A1 Jul. 15, 2021

(51) Int. Cl.

| | |
|---|---|
| ***A41F 5/00*** | (2006.01) |
| ***A41F 18/00*** | (2006.01) |
| ***A41F 9/02*** | (2006.01) |
| ***A41F 9/00*** | (2006.01) |
| ***A41F 3/02*** | (2006.01) |

(52) U.S. Cl.

CPC ..... *A41F 5/00* (2013.01); *A41F 9/002* (2013.01); *A41F 9/025* (2013.01); *A41F 18/00* (2013.01); *A41F 3/02* (2013.01)

(58) Field of Classification Search

CPC ..... A41F 3/00; A41F 3/02; A41F 3/04; A41F 5/00; A41F 9/00; A41F 9/002; A41F 9/005; A41F 9/02; A41F 9/025; A41F 18/00

USPC ..... 2/311, 312

See application file for complete search history.

(56) References Cited

U.S. PATENT DOCUMENTS 429,910 A * 6/1890 Hellenberg ..... A41F 9/002 2/300
435,257 A * 8/1890 Teel ..... A41F 9/002 2/300
648,267 A * 4/1900 Koch ..... A41F 11/16 2/311
1,383,062 A 6/1921 Bascome
1,600,027 A * 9/1926 Welsand ..... A62B 35/00 224/223
2,362,732 A 11/1944 Tarbox
2,914,070 A * 11/1959 Kellner ..... A41F 9/002 450/134
3,001,202 A * 9/1961 Serrano ..... A41F 9/002 2/102
3,119,117 A * 1/1964 Serrano ..... A41F 9/002 2/102
3,470,567 A * 10/1969 Dellaguzzo ..... A41D 1/04 2/102
3,530,508 A * 9/1970 Pavlou ..... A41D 1/04 2/102
4,472,839 A * 9/1984 Johansen ..... A41F 9/002 128/DIG. 15
5,172,429 A * 12/1992 Lucier ..... A41F 3/02 2/300
5,173,969 A * 12/1992 Fredrickson ..... A41F 9/002 2/311
5,232,031 A * 8/1993 Fredrickson ..... A41F 9/002 144/259

(Continued)

*Primary Examiner* — F Griffin Hall

(57) ABSTRACT

A cummerbund belt assembly for retaining a cummerbund in a preferred position includes a cummerbund is wearable around a waist of a user to enhance the appearance of formal dress. A plurality of couplers is each coupled to and extends downwardly from the cummerbund. Each of the couplers is positioned at strategic locations along the cummerbund such that each of the couplers is aligned with a respective plurality of suspender buttons in the trousers. Moreover, each of the couplers releasably engages the respective suspender button to inhibit the cummerbund from riding upwardly on the user's waist when the cummerbund and the trousers are worn.

5 Claims, 4 Drawing Sheets

(56) References Cited

U.S. PATENT DOCUMENTS

| | | | | |
|---|---|---|---|---|
| 6,189,154 | B1 * | 2/2001 | Ducharme | A45C 13/02 2/247 |
| 6,308,338 | B1 * | 10/2001 | Caldwell | A41D 1/062 2/312 |
| 10,368,599 | B1 | 8/2019 | Bounkhong | |
| 10,973,270 | B2 * | 4/2021 | Marshall | A45F 3/005 |
| 2010/0037371 | A1 | 2/2010 | Lewis | |
| 2013/0025029 | A1 | 1/2013 | Ham | |
| 2019/0059484 | A1 * | 2/2019 | Ahmad | A41F 3/00 |
| 2019/0166983 | A1 | 6/2019 | Moreland | |

* cited by examiner

CUMMERBUND BELT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to cummerbund devices and more particularly pertains to a new cummerbund device for retaining a cummerbund in a preferred position.

(2) Description of Related Art Including Information Disclosed Under 37 CFR 1.97 and 1.98

The prior art relates to cummerbund devices. The prior art discloses a waist belt that clips onto trousers for inhibiting the trousers from falling while wearing. Additionally, the prior art discloses a waist belt that has button holes integrated therein for engaging suspender buttons on trousers. The prior art discloses a cummerbund that has a plurality of button holes being integrated therein for releasably engaging a fastener. The prior art also discloses a set of trouser suspender for retaining trousers in a predetermined position below a waist of a user.

BRIEF SUMMARY OF THE INVENTION

An embodiment of the disclosure meets the needs presented above by generally comprising a cummerbund is wearable around a waist of a user to enhance the appearance of formal dress. A plurality of couplers is each coupled to and extends downwardly from the cummerbund. Each of the couplers is positioned at strategic locations along the cummerbund such that each of the couplers is aligned with a respective plurality of suspender buttons in the trousers. Moreover, each of the couplers releasably engages the respective suspender button to inhibit the cummerbund from riding upwardly on the user's waist when the cummerbund and the trousers are worn.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
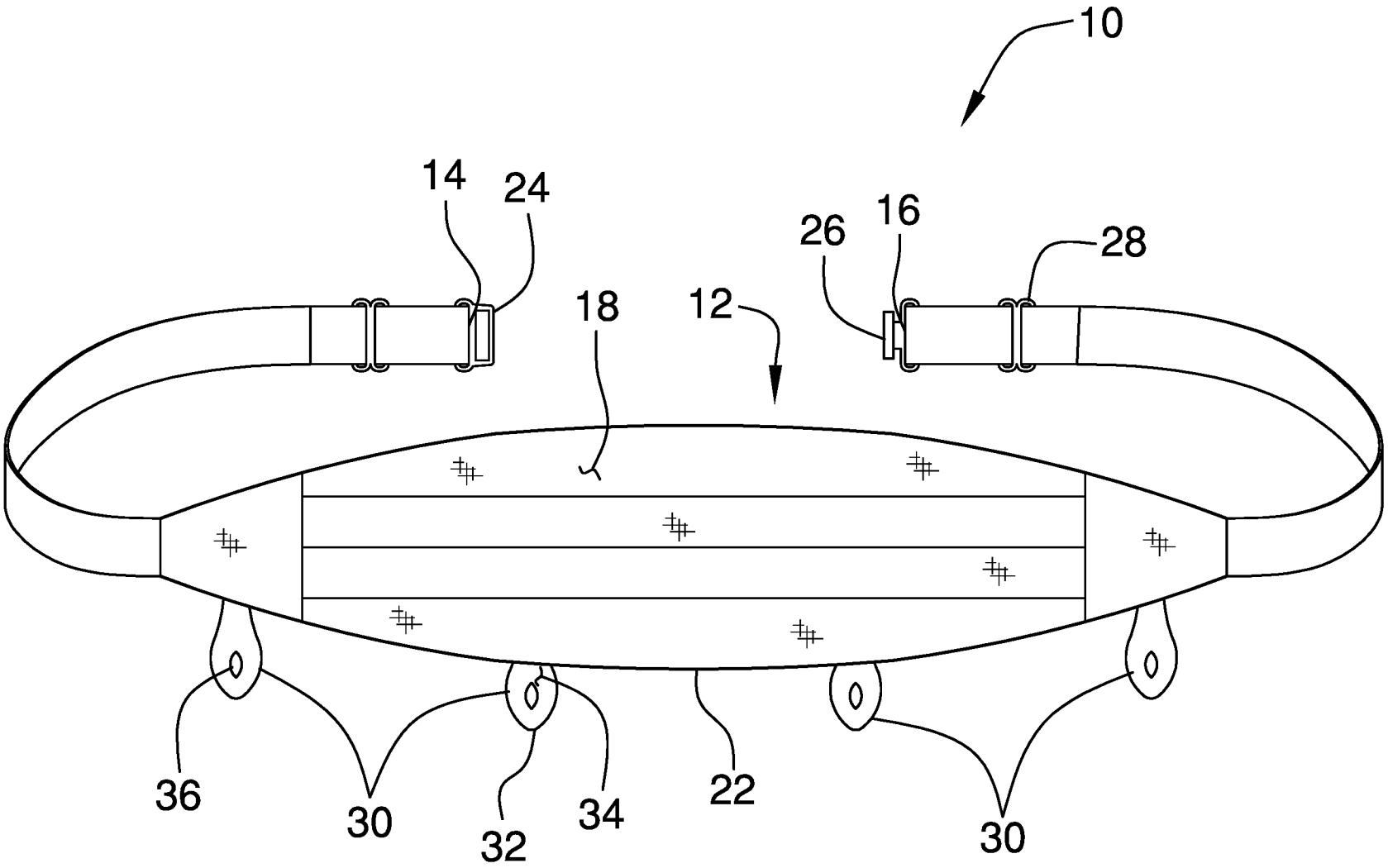
FIG. 1 is a front view of a cummerbund belt assembly according to an embodiment of the disclosure.
Figure 2:
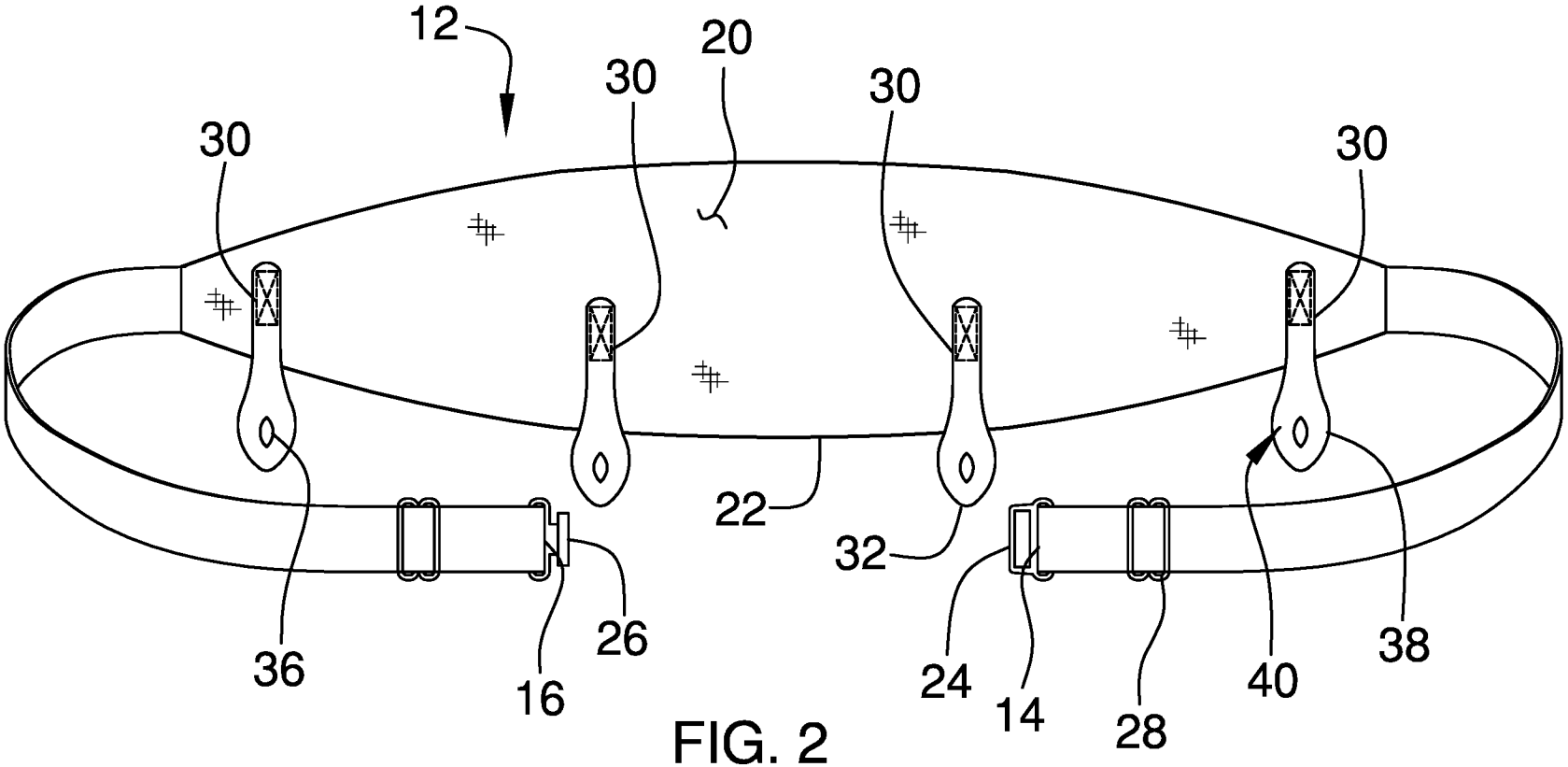
FIG. 2 is a back view of an embodiment of the disclosure.
Figure 3:
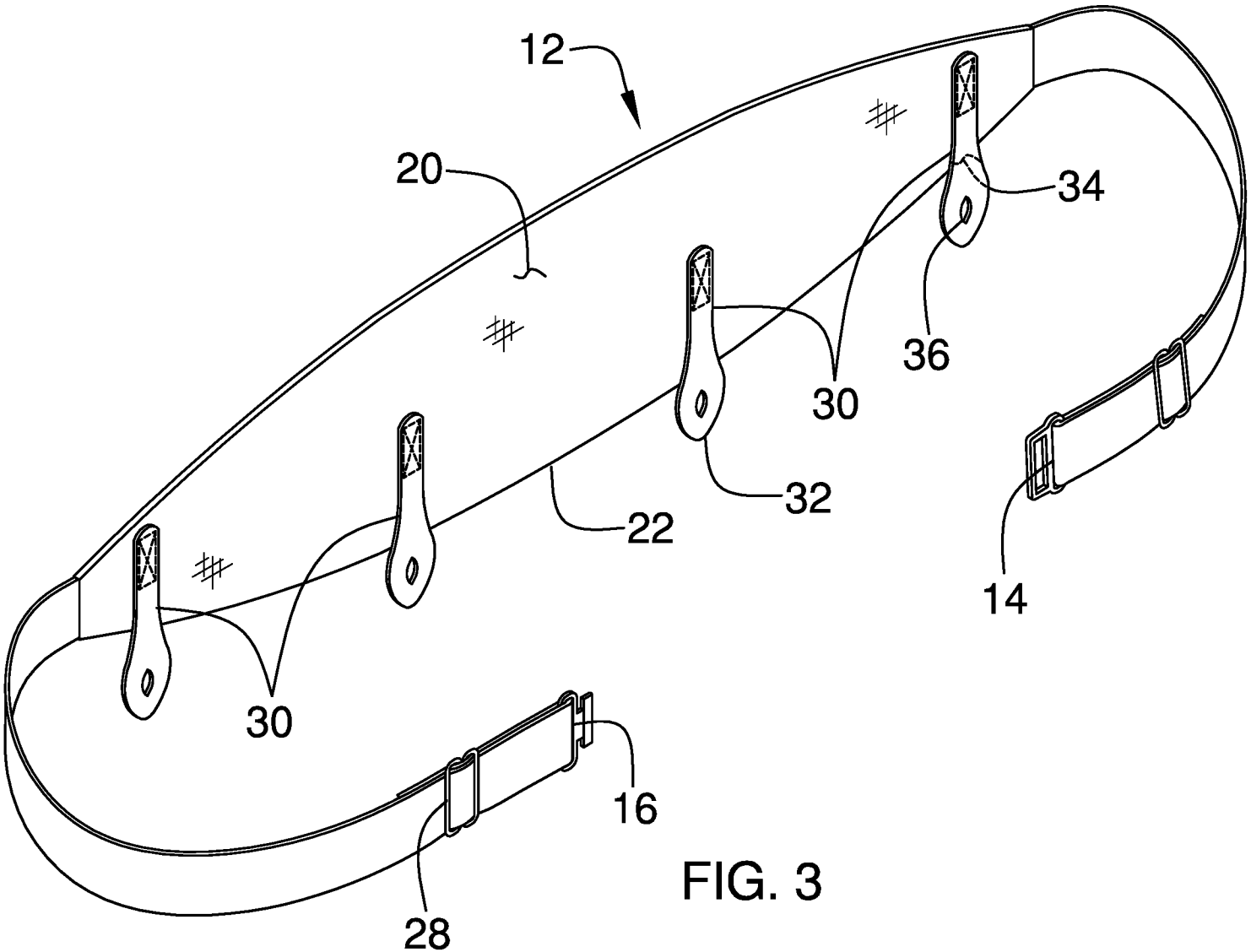
FIG. 3 is a back perspective view of an embodiment of the disclosure.
Figure 4:
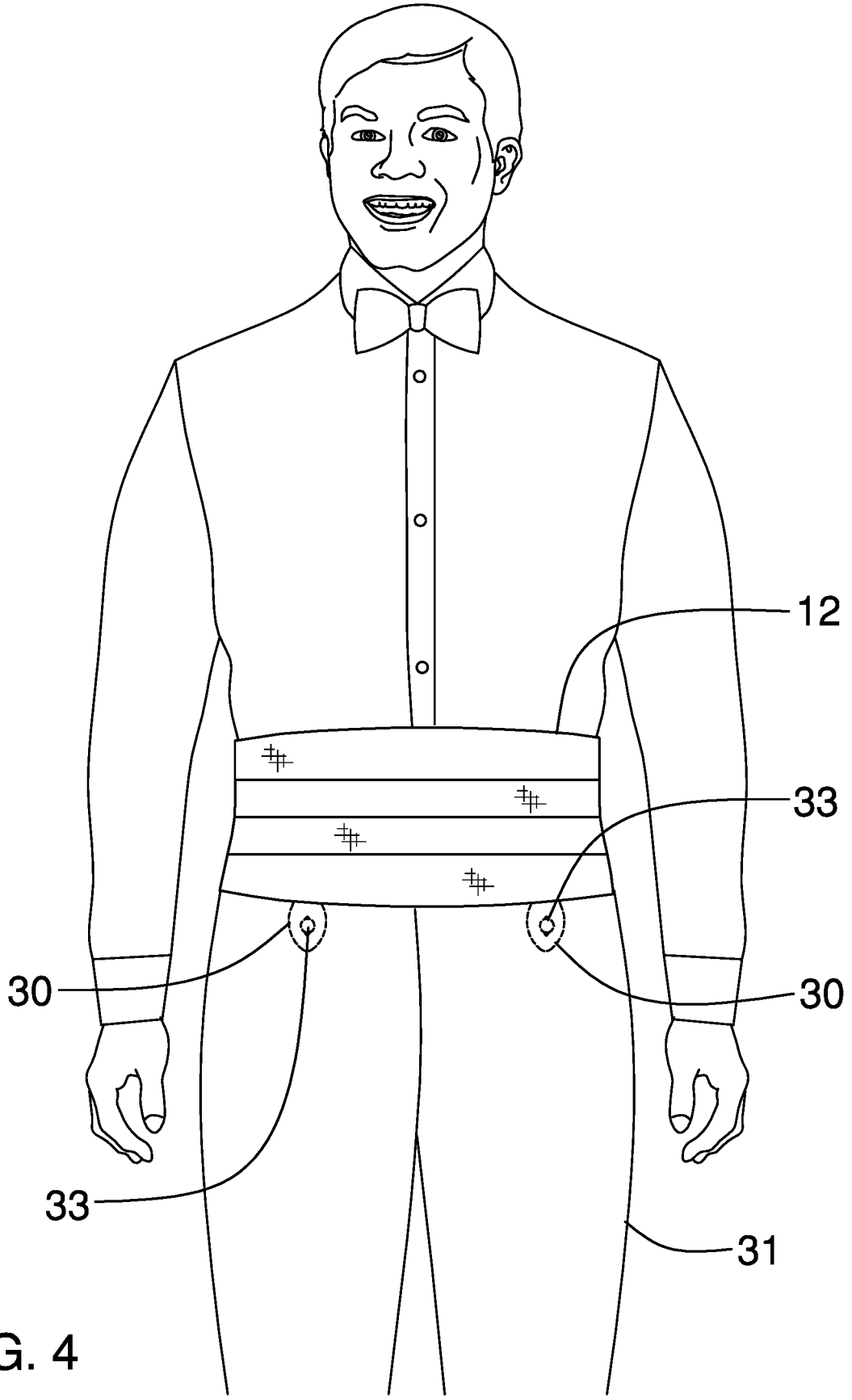
FIG. 4 is a perspective in-use view of an embodiment of the disclosure.

With reference now to the drawings, and in particular to FIGS. 1 through 4 thereof, a new cummerbund device embodying the principles and concepts of an embodiment of the disclosure and generally designated by the reference numeral 10 will be described.

As best illustrated in FIGS. 1 through 4, the cummerbund belt assembly 10 generally comprises a cummerbund 12 that is wearable around a waist of a user to enhance the appearance of formal dress. The cummerbund 12 has a first end 14, a second end 16, a front surface 18, a back surface 20 and a lower edge 22. Additionally, the first end 14 is matable to the second end 16 for retaining the cummerbund 12 around the user's waist. A first fastener 24 may be coupled to the first end 14 and a second fastener 26 may be coupled to the second end 16; the first fastener 24 may releasably engage the second fastener 26. Additionally, the cummerbund 12 includes a slidable adjuster 28 for adjusting the overall length of the cummerbund 12. The cummerbund 12 may be structured to have the ornamental appearance of a traditional cummerbund, including but not being limited to, pleats, silk, satin and other features common to traditional cummerbunds.

A plurality of couplers 30 is provided and each of the couplers 30 is coupled to and extends downwardly from the cummerbund 12. In this way each of the couplers 30 extends between a waist band of trousers 31 and the user's waist when the cummerbund 12 is worn. Each of the couplers 30 is positioned at strategic locations along the cummerbund 12. Thus, each of the couplers 30 is aligned with a respective plurality of suspender buttons 33 in the trousers 31. Moreover, each of the couplers 30 releasably engages the respective suspender button to inhibit the cummerbund 12 from riding upwardly on the user's waist when the cummerbund 12 and the trousers 31 are worn.

Each of the couplers 30 has a free end 32 and a front surface 34, and the front surface 34 of each of the couplers 30 is coupled to the back surface 20 of the cummerbund 12. Additionally, the free end 32 of each of the couplers 30 is spaced downwardly from the lower edge 22 of the cummerbund 12. Each of the couplers 30 has a slot 36 extending therethrough to insertably receive the respective suspender button. Additionally, a perimeter edge 38 of each of the couplers 30 flares outwardly between the lower edge 22 of the cummerbund 12 and the free end 32 to define a rounded portion 40 on each of the couplers 30. The slot 36 is vertically oriented on the rounded portion 40 to enhance coupling between the respective suspender button and the couplers 30. The couplers 30 are spaced apart from each other and are distributed along the lower edge 22 of the cummerbund 12.

In use, the cummerbund 12 is worn during a formal dress occasion that involves a tuxedo or other type of formal dress for a male. Each of the couplers 30 is coupled to the respective suspender button in the trousers 31. In this way the cummerbund 12 is inhibited from riding upwardly on the user while the cummerbund 12 is being worn. Thus, the formal appearance of the user is continuously maintained, even during repeated sitting down and standing up. Moreover, the cummerbund 12 can be included in formal dress rentals or the like for enhancing the performance and ornamental appeal of the formal dress rental.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cummerbund belt assembly being configured to removably engage suspender buttons on a pair of trousers for formal dress, said assembly comprising:

a cummerbund configured to be worn around a waist of a user, wherein said cummerbund is configured to enhance the appearance of formal dress, said cummerbund having a back surface and a lower edge; and a plurality of couplers, each of said couplers being coupled to and extending downwardly from said cummerbund, wherein each of said couplers is configured to extend between a waist band of trousers and the user's waist when said cummerbund is worn, each of said couplers being positioned at locations along said cummerbund wherein each of said couplers is configured to be aligned with a respective suspender button of a plurality of suspender buttons in the trousers, each of said couplers releasably engaging the respective suspender button, wherein said cummerbund is configured to be inhibited from riding upwardly on the user's waist when said cummerbund and the trousers are worn, each of said couplers having a free end and a front surface, a lowermost edge of attachment between said front surface of said coupler and said back surface of said cummerbund being spaced above said lower edge of said cummerbund, said free end being spaced downwardly from said lower edge of said cummerbund, each of said couplers having a slot extending therethrough wherein said slot is configured to insertably receive the respective suspender button, said slot of each of said couplers being spaced downwardly from said lower edge of said cummerbund wherein each said coupler is configured to engage the respective suspender button with the cummerbund overlapping a top of the waist of the trousers.

2. The assembly according to claim 1, wherein said cummerbund has a first end, a second end, and a front surface, said first end being matable to said second end for retaining said cummerbund around the user's waist.

3. The assembly according to claim 1, further comprising a perimeter edge of each of said couplers flaring outwardly between said lower edge of said cummerbund and said free end to define a rounded portion on each of said couplers, said slot being vertically oriented on said rounded portion wherein said rounded portion is configured to enhance coupling between the respective suspender button and said couplers.

4. The assembly according to claim 1, wherein said couplers are spaced apart from each other and are distributed along said lower edge of said cummerbund.

5. A cummerbund belt assembly being configured to removably engage suspender buttons on a pair of trousers for formal dress, said assembly comprising:

a cummerbund configured to be worn around a waist of a user, wherein said cummerbund is configured to enhance the appearance of formal dress, said cummerbund having a first end, a second end, a front surface, a back surface and a lower edge, said first end being ratable to said second end for retaining said cummerbund around the user's waist; and a plurality of couplers, each of said couplers being coupled to and extending downwardly from said cummerbund wherein each of said couplers is configured to extend between a waist band of trousers and the user's waist when said cummerbund is worn, each of said couplers being positioned at locations along said cummerbund, wherein each of said couplers is configured to be aligned with a respective suspender button of a plurality of suspender buttons in the trousers, each of said couplers releasably engaging the respective suspender button, wherein said cummerbund is configured to be inhibited from riding upwardly on the user's waist when said cummerbund and the trousers are worn, each of said couplers having a free end and a front surface, said front surface being coupled to said back surface of said cummerbund, a lowermost edge of attachment between said front surface of said coupler and said back surface of said cummerbund being spaced above said lower edge of said cummerbund, said free end being spaced downwardly from said lower edge of said cummerbund, each of said couplers having a slot extending therethrough wherein said slot is configured to insertably receive the respective suspender button, said slot of each of said couplers being spaced downwardly from said lower edge of said cummerbund wherein each said coupler is configured to engage the respective suspender button with the cummerbund overlapping a top of the waist of the trousers, a perimeter edge of each of said couplers flaring outwardly between said lower edge of said cummerbund and said free end to define a rounded portion on each of said couplers, said slot being vertically oriented on said rounded portion wherein said rounded portion is configured to enhance coupling between the respective suspender button and said couplers, said couplers being spaced apart from each other and being distributed along said lower edge of said cummerbund.

* * * * *